US012303015B1

(12) United States Patent
Boler

(10) Patent No.: US 12,303,015 B1
(45) Date of Patent: May 20, 2025

(54) PORTABLE COATING APPLICATOR KIT

(71) Applicant: Lewyn Boler, Stockton, CA (US)

(72) Inventor: Lewyn Boler, Stockton, CA (US)

( * ) Notice: Subject to any disclaimer, the term of this patent is extended or adjusted under 35 U.S.C. 154(b) by 0 days.

(21) Appl. No.: 18/895,481

(22) Filed: Sep. 25, 2024

(51) Int. Cl.
*A46B 17/02* (2006.01)
*A46B 9/02* (2006.01)

(52) U.S. Cl.
CPC ..... *A46B 17/02* (2013.01); *A46B 9/02* (2013.01); *A46B 2200/20* (2013.01)

(58) Field of Classification Search
CPC ..... A46B 17/02; A46B 9/02; A46B 2200/20; A46B 11/00
USPC ..... 401/118, 123, 125
See application file for complete search history.

(56) References Cited

U.S. PATENT DOCUMENTS 3,031,711 A * 5/1962 Herman ..... A47L 23/05 401/139
5,558,453 A * 9/1996 Bell ..... A45D 34/06 401/137
6,302,608 B1 * 10/2001 Holmes ..... B65D 23/12 215/390
7,273,326 B2 * 9/2007 Jones ..... A46B 15/0091 401/125

* cited by examiner

*Primary Examiner* — David J Walczak
(74) *Attorney, Agent, or Firm* — Donald J. Ersler

(57) ABSTRACT

A portable coating applicator kit preferably includes a liquid jug, an applicator brush, and a surface coating liquid. The liquid jug preferably includes an integral handle, a pour spout and a removable cap. A brush opening is formed through a side wall of the liquid, such that a small amount of surface coating liquid may be retained in a bottom of the liquid jug. A height of the brush opening is sufficient to allow the plurality of bristles to be freely inserted into the brush opening to coat tips thereof with the surface coating liquid. The brush preferably includes a brush handle and a brush tether. The brush tether extends from a free end of the brush handle. The brush tether preferably includes a flexible line and a hook. The hook is preferably large enough to hook around a bottom of the integrated handle.

11 Claims, 5 Drawing Sheets

PORTABLE COATING APPLICATOR KIT

BACKGROUND OF THE INVENTION

1. Field of the Invention

The present invention relates generally to the application of a coating liquid to a surface, such as a tire, and the storage of an applicator, such as a brush in a portable container, such as a jug. The portable container includes an opening to receive and store the applicator and to replenish the coating liquid for each use. The coating liquid is stored in a bottom of the portable container. The applicator is designed to apply a small amount of coating liquid to the surface, the applicator is stored in the portable container when not in use.

2. Discussion of the Prior Art

It appears the prior art does not disclose a portable surface coating applicator kit, which includes an open portable container, such as a jug for retaining a coating liquid, and a tethered and removable applicator such as a brush for applying the coating liquid to a surface, such as a tire.

Accordingly, there is a clearly felt need in the art for a tire coating applicator kit, which provides a portable, ready to use system to treat a surface, such as tires of a plurality of vehicles with a coating liquid.

SUMMARY OF THE INVENTION

The present invention provides a portable surface coating applicator kit, which includes a container, such as a jug for storing a surface coating liquid and an applicator, such as a brush. The surface coating applicator kit preferably includes a container, such as a jug, an applicator such as a brush, and a surface coating liquid. The portable container preferably includes an integral handle, an optional pour spout and an optional removable cap. An opening is formed through a wall of the portable container, such that a small amount of the coating liquid may be poured into a bottom of the portable liquid container. A height of the opening is sufficient to allow an applicator, such as a brush to be freely inserted into the opening to coat the applicator, such as a plurality of bristles of a brush with the coating liquid. The container is preferably similar to a container used to store window washer fluid, but other designs of liquid containers may also be used. The applicator preferably includes a handle, such as a brush handle, a brush tether and the plurality of bristles. A surface height of the plurality of bristles is preferably about equal to a sidewall height of a standard automobile tire. The brush tether extends from a free end of the brush handle. The brush tether preferably includes a flexible line and a hook. One end of the hook extends from one end of the flexible line and the other end of the flexible line is attached to the free end of the brush handle. The hook is preferably large enough to hook around a bottom of the integrated handle.

In use, a small amount of tire coating is poured into a bottom of the liquid container through the brush opening. A tip of the applicator, such as a plurality of brush bristles are dipped into the surface coating liquid. The plurality of brush bristles are then applied to a surface of a sidewall of a tire to coat the sidewall with the coating liquid. Unused coating liquid in the bottom of the liquid container remains in the portable container for future use, when the surface coating is done.

Accordingly, it is an object of the present invention to provide a surface coating applicator kit, which includes a portable liquid container for storing a small amount of a surface coating liquid and an applicator, such as a brush.

These and additional objects, advantages, features and benefits of the present invention will become apparent from the following specification.

DETAILED DESCRIPTION OF THE PREFERRED EMBODIMENTS

Figure 1:
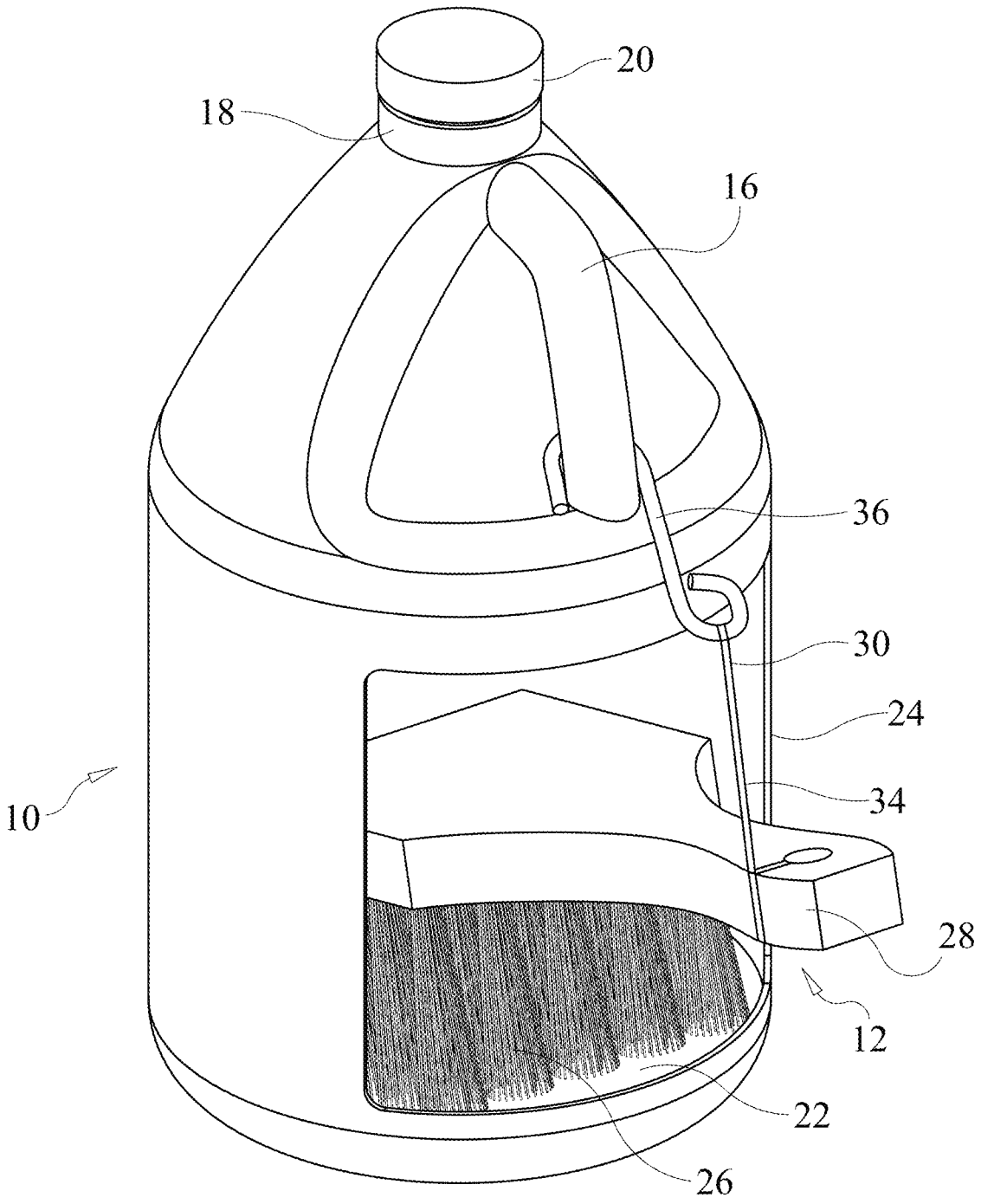
FIG. 1 is a perspective view of a tire coating applicator kit in accordance with the present invention.
Figure 2:
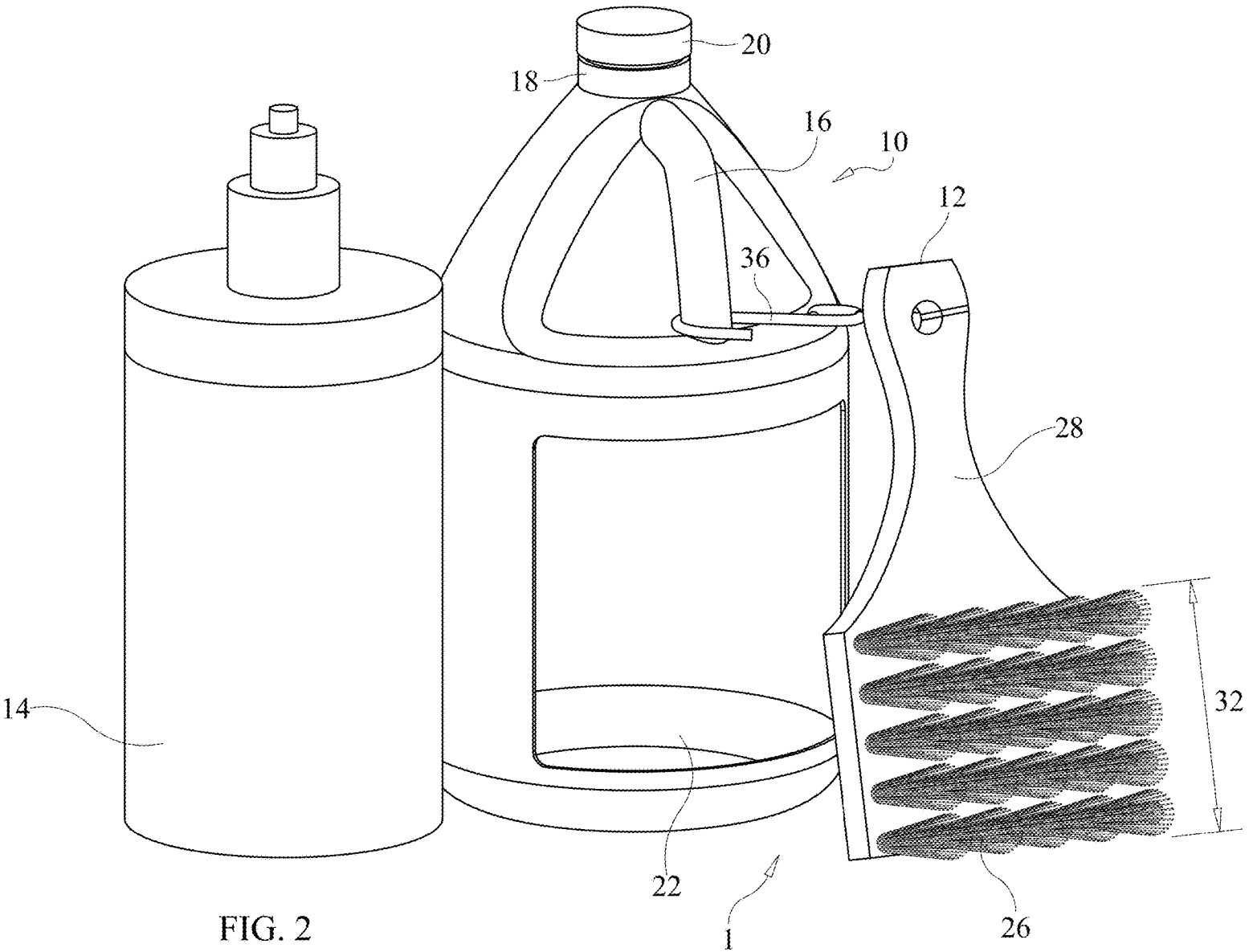
FIG. 2 is an exploded perspective view of a tire coating applicator kit in accordance with the present invention.
Figure 3:
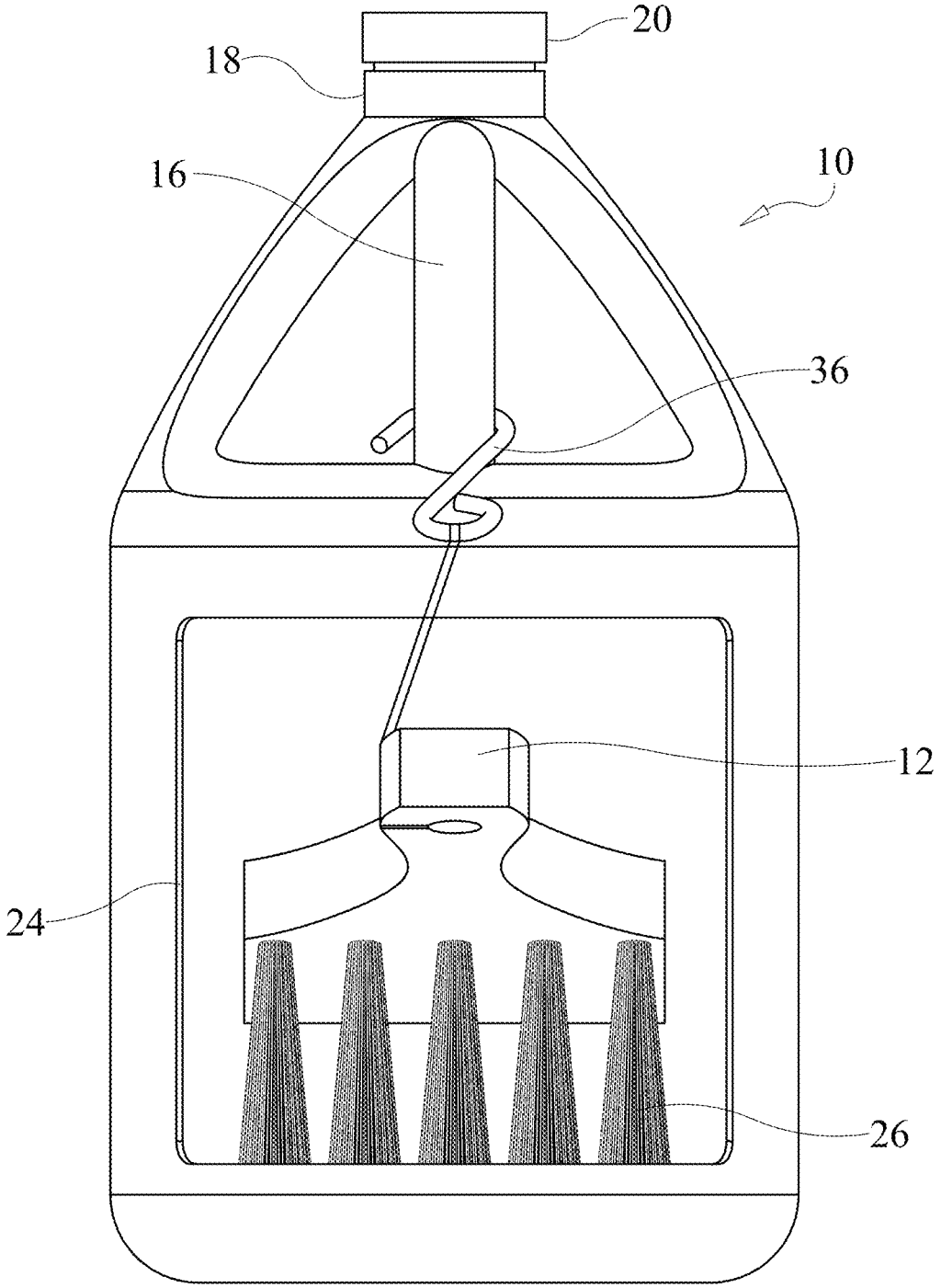
FIG. 3 is an enlarged front view of a top portion of a liquid jug of a tire coating applicator kit in accordance with the present invention.
Figure 4:
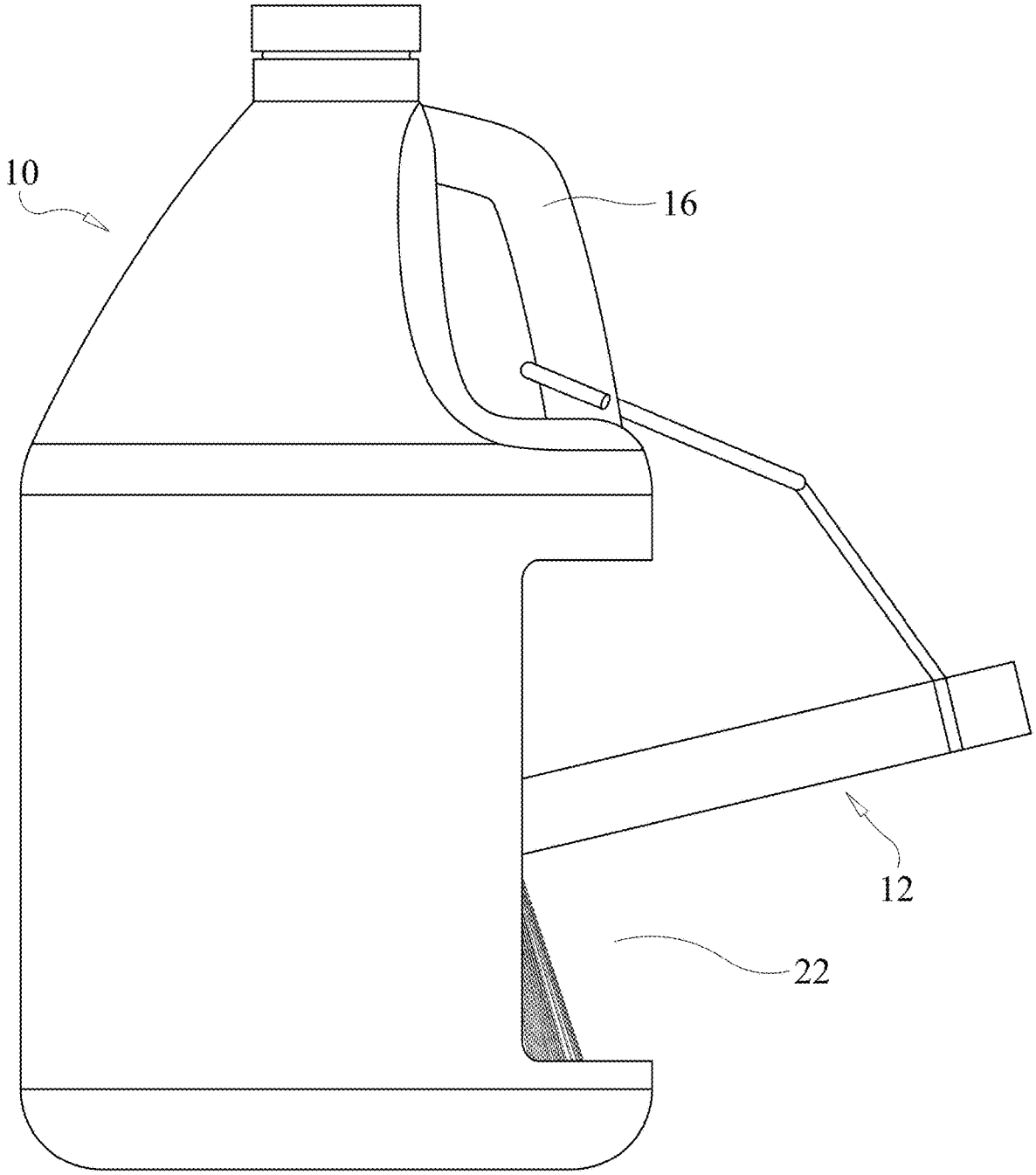
FIG. 4 is a side perspective view of a liquid jug of a tire coating applicator kit in accordance with the present invention.
Figure 5:
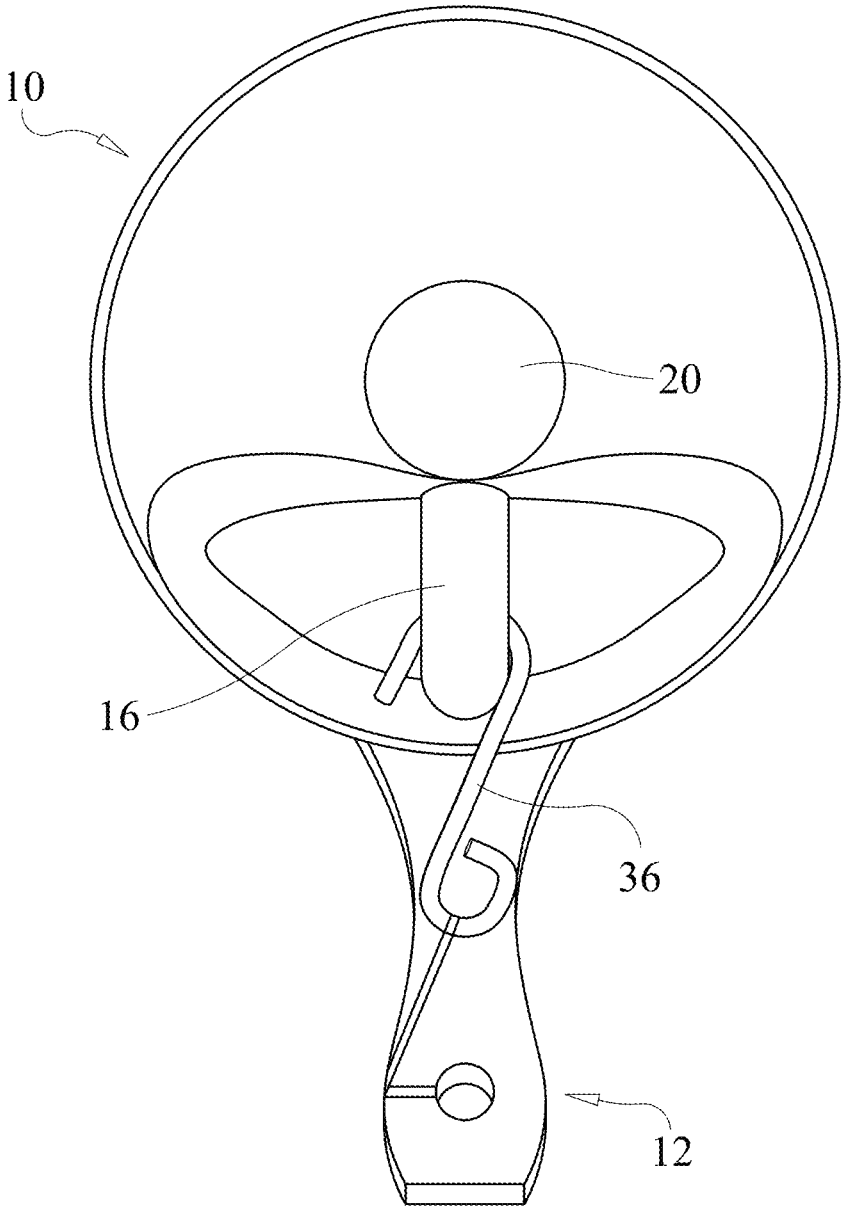
FIG. 5 is a top view of a liquid jug of a tire coating applicator kit in accordance with the present invention.

With reference now to the drawings, and particularly to FIGS. 1-2, a portable coating applicator kit 1 preferably includes a liquid container 10, an applicator brush 12, and a surface coating liquid 14. The liquid container 10 preferably includes an integral handle 16, a pour spout 18 and a removable cap 20. A brush opening 22 is formed through a side wall 24 of the liquid container 10, such that a small amount of tire coating liquid 14 may be retained in a bottom of the liquid container 10. A height of the brush opening 22 is sufficient to allow the applicator brush 12 to be freely inserted into the brush opening 22 to coat tips of the bristles 26 with the surface coating liquid 14. The liquid container 10 is preferably similar to a liquid container used to store window washer fluid, but other designs of liquid containers or jugs may also be used.

The applicator brush 12 preferably includes the plurality of bristles 26, a brush handle 28 and a brush tether 30. A bristle surface height 32 is preferably equal to a side wall height of a tire. The brush tether 30 extends from a free end of the brush handle 28. The brush tether 30 preferably includes a flexible line 34 and a hook 36. One end of the hook 36 extends from one end of the flexible line 34 and the other end of the flexible line 34 is attached to the free end of the brush handle 28. The hook 36 is preferably large enough to hook around a bottom of the integrated handle 16.

In use, a small amount of surface coating liquid 14 is poured into a bottom of the liquid container 10 through the brush opening 22. A tip of the plurality of bristles 26 are dipped into the surface coating liquid 14. The brush bristles 26 are then applied to the side wall of a tire (not shown) or other surface to coat the tire side wall with the surface coating liquid 14. Optionally, surface coating liquid 14 in a bottom of the liquid container 10 is poured back into a container of surface coating liquid 14 or disposed of by unscrewing the removable cap 20 from the pour spout 18 and pouring the contents of the liquid container 10 through the pour spot 18, when the tire treatment is done.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A portable coating applicator kit, comprising:

an applicator brush includes a plurality of bristles extending in a longitudinal direction along and axis and a brush handle, said axis of said plurality of bristles is perpendicular to a lengthwise axis of said handle when said brush handle is attached to said plurality of bristles; and a liquid container includes an integral handle, a brush opening is formed through a side wall of said liquid container to receive said applicator brush, a bottom of said brush opening is high enough to retain a quantity of surface coating liquid at a bottom of said liquid container.

2. The portable coating applicator kit of claim 1, wherein:

a height of said brush opening is sufficient to allow said plurality of bristles to be freely inserted into the brush opening to coat tips thereof with the quantity of liquid.

3. The portable coating applicator kit of claim 1, wherein:

a surface height of said plurality of bristles corresponds to a side wall thickness of a tire.

4. A portable coating applicator kit, comprising:

an applicator brush includes a plurality of bristles, a brush handle and a brush tether, one end of said brush tether is retained on said brush handle, a hook is retained on an opposing end of said brush tether; and a liquid container includes an integral handle and a pour spout, a brush opening is formed through a side wall of said liquid container to receive said applicator brush, a bottom of said brush opening is high enough to retain a quantity of surface coating liquid at a bottom of said liquid container, said hook is sized to receive said integral handle.

5. The portable coating applicator kit of claim 4, wherein:

a height of said brush opening is sufficient to allow said plurality of bristles to be freely inserted into the brush opening to coat tips thereof with the liquid.

6. The portable coating applicator kit of claim 4, wherein:

a surface height of said plurality of bristles corresponds to a side wall thickness of a tire.

7. The portable coating applicator kit of claim 4, wherein:

said brush tether includes a flexible line and said hook, one end of said hook extends from one end of said flexible line, an opposing end of said flexible line is attached to said brush handle.

8. A portable coating applicator kit, comprising:

an applicator brush includes a plurality of bristles, a brush handle and a brush tether, one end of said brush tether is retained on said brush handle, a hook is retained on an opposing end of said brush tether;

a quantity of surface coating liquid;

a liquid container includes an integral handle and a pour spout, a brush opening is formed through a side wall of said liquid container to receive an applicator brush, a bottom of said brushing opening is high enough to retain said quantity of surface coating liquid at a bottom of said liquid container, said hook is sized to receive said integral handle.

9. The portable coating applicator kit of claim 8, wherein:

a height of said brush opening is sufficient to allow said plurality of bristles to be freely inserted into the brush opening to coat tips of said plurality of bristles with the tire coating liquid.

10. The portable coating applicator kit of claim 8, wherein:

a surface height of said plurality of bristles corresponds to a side wall thickness of a tire.

11. The portable coating applicator kit of claim 8, wherein:

said brush tether includes a flexible line and said hook, one end of said hook extends from one end of said flexible line, an opposing end of said flexible line is attached to said brush handle.

* * * * *